US007869757B2

(12) United States Patent
Hattori

(10) Patent No.: US 7,869,757 B2
(45) Date of Patent: Jan. 11, 2011

(54) BOOKBINDING APPARATUS AND BOOKBINDING SYSTEM

(75) Inventor: Masato Hattori, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 581 days.

(21) Appl. No.: 11/906,904

(22) Filed: Oct. 4, 2007

(65) Prior Publication Data

US 2008/0112778 A1 May 15, 2008

(30) Foreign Application Priority Data

Nov. 7, 2006 (JP) ..... 2006-301325

(51) Int. Cl.
*G03G 15/00* (2006.01)

(52) U.S. Cl. ..... 399/408; 399/407

(58) Field of Classification Search ..... 399/408, 399/407

See application file for complete search history.

(56) References Cited

U.S. PATENT DOCUMENTS 3,980,514 A * 9/1976 Rosette et al. ..... 156/539
5,605,575 A * 2/1997 Anderson ..... 118/679
5,632,853 A * 5/1997 Montandon et al. ..... 156/578
7,156,601 B2 * 1/2007 Cobene, II ..... 412/8
7,527,465 B2 * 5/2009 Toyoizumi et al. ..... 412/37
7,584,949 B2 * 9/2009 Kaneko et al. ..... 270/58.12
2007/0193511 A1 * 8/2007 Sasamoto et al. ..... 118/666

FOREIGN PATENT DOCUMENTS

JP 2004-209746 A 7/2004
JP 2007-76118 A 3/2007

* cited by examiner

*Primary Examiner*—Anthony H. Nguyen
(74) *Attorney, Agent, or Firm*—Holtz, Holtz, Goodman & Chick, PC

(57) ABSTRACT

A bookbinding apparatus comprising: a supplier which supplies solid adhesive to an adhesive tank; a melting section which melts the solid adhesive supplied to the adhesive tank; a coating member which coats the adhesive melted in the adhesive tank to an end face of a booklet; and a separating section which separates between a place in which the solid adhesive is supplied by the supplier and the coating member in the adhesive tank.

13 Claims, 9 Drawing Sheets

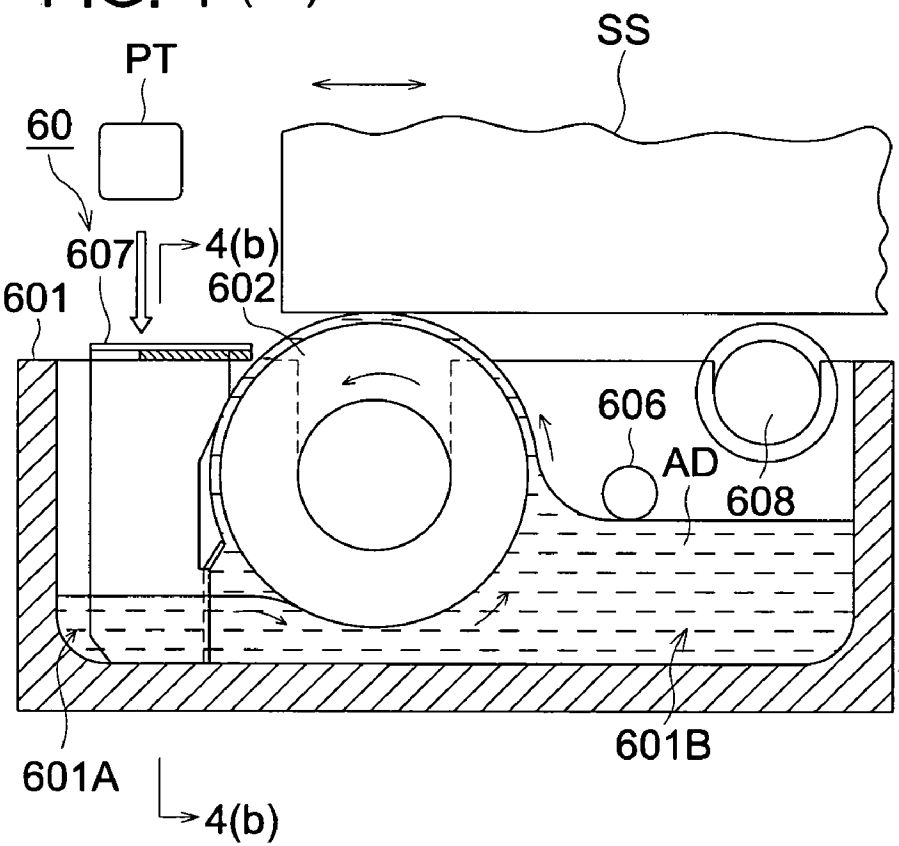
FIG. 4 ( a )
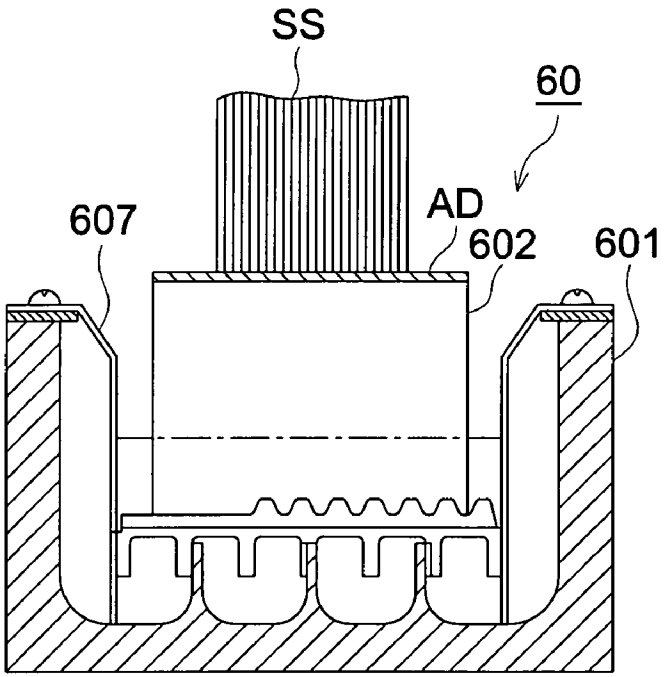
FIG. 4 ( b )

BOOKBINDING APPARATUS AND BOOKBINDING SYSTEM

This application is based on Japanese Patent Application No. 2006-301325 filed on Nov. 7, 2006, which is incorporated hereinto by reference.

BACKGROUND OF THE INVENTION

The present invention relates to a bookbinding apparatus and bookbinding system for forming a booklet by coating adhesive on the edge (spine) of a plurality of stacked sheets, particularly to a bookbinding apparatus and bookbinding system wherein adhesive is coated for each booklet.

There is a conventionally known bookbinding apparatus wherein adhesive is coated on each booklet and sheets are formed in a bundle, and this apparatus is used in a bookbinding system wherein all operations from image forming to bookbinding are performed in an integrated manner. In such a bookbinding apparatus, a hot melt adhesive is used as an adhesive, and adhesive pellets (solid glue) are supplied little by little in response to the amount consumed in coating, whereby bookbinding operation is performed on a continuous basis. In Unexamined Japanese Patent Application Publication No. 2004-209746, disclosed a supply apparatus wherein adhesive is coated on the sheet bundle by the traveling of a coating roller along the spine of a sheet bundle, and a predetermined amount of adhesive pellets are supplied little by little in units of several pellets into the melt adhesive tank wherein the coating roller is immersed.

In the Unexamined Japanese Patent Application Publication No. 2004-209746, when the amount of adhesive in the adhesive tank has been reduced, pellets are supplied in predetermined amount, whereby the liquid level of the adhesive is kept constant.

However, the bookbinding apparatus of the Unexamined Japanese Patent Application Publication No. 2004-209746 is designed in such a way that the solid glue is directly put into the melt glue portion wherein a coating roller is immersed. Thus, the half-melt solid glue is dipped up by the coating roller, and reaches the glue applied portion wherein the spine portion of the booklet conveyed comes in contact with the coating roller, with the result that a bookbinding failure occurs.

Further, there is an attempt having been made so that the solid glue conveyance distance from the position for supplying solid glue into the melting tank, to the coating roller is set to a long distance so that the solid glue having been melted sufficiently inside the melting tank is supplied to the coating roller. This attempt, however, increases the size of the melting tank and the volume of evaporation of the melted glue inside the melting tank. This problem also leads to an increase in the melting warm-up time of the solid glue at the start of bookbinding.

SUMMARY OF THE INVENTION

One aspect of the present invention is as follows.

A bookbinding apparatus including: a supplier for supplying solid adhesive to an adhesive tank; a melting section for melting the solid adhesive supplied to the aforementioned adhesive tank; a coating member for applying the adhesive melted in the aforementioned adhesive tank to the end face of the booklet; and a separating section for separating between the place supplied with the solid adhesive by the supplier and the coating member in the aforementioned adhesive tank.

Another aspect of the present invention is as follows.

A bookbinding system including an image forming apparatus for forming an image on a sheet; and the bookbinding apparatus described above that receiving the sheet from the aforementioned image forming apparatus to perform the process of gluing and bookbinding.

BRIEF DESCRIPTION OF THE DRAWINGS

FIG. 4(*a*) is a side elevation view of the coating section and FIG. 4(*b*) is an elevation view in cross section taken along arrow line 4(*b*)-4(*b*) in FIG. 4(*a*) representing the coating section;

DETAILED DESCRIPTION OF THE PREFERRED EMBODIMENT

The following describes the present invention with reference to the embodiment of the present invention without being restricted thereto.

Figure 1:
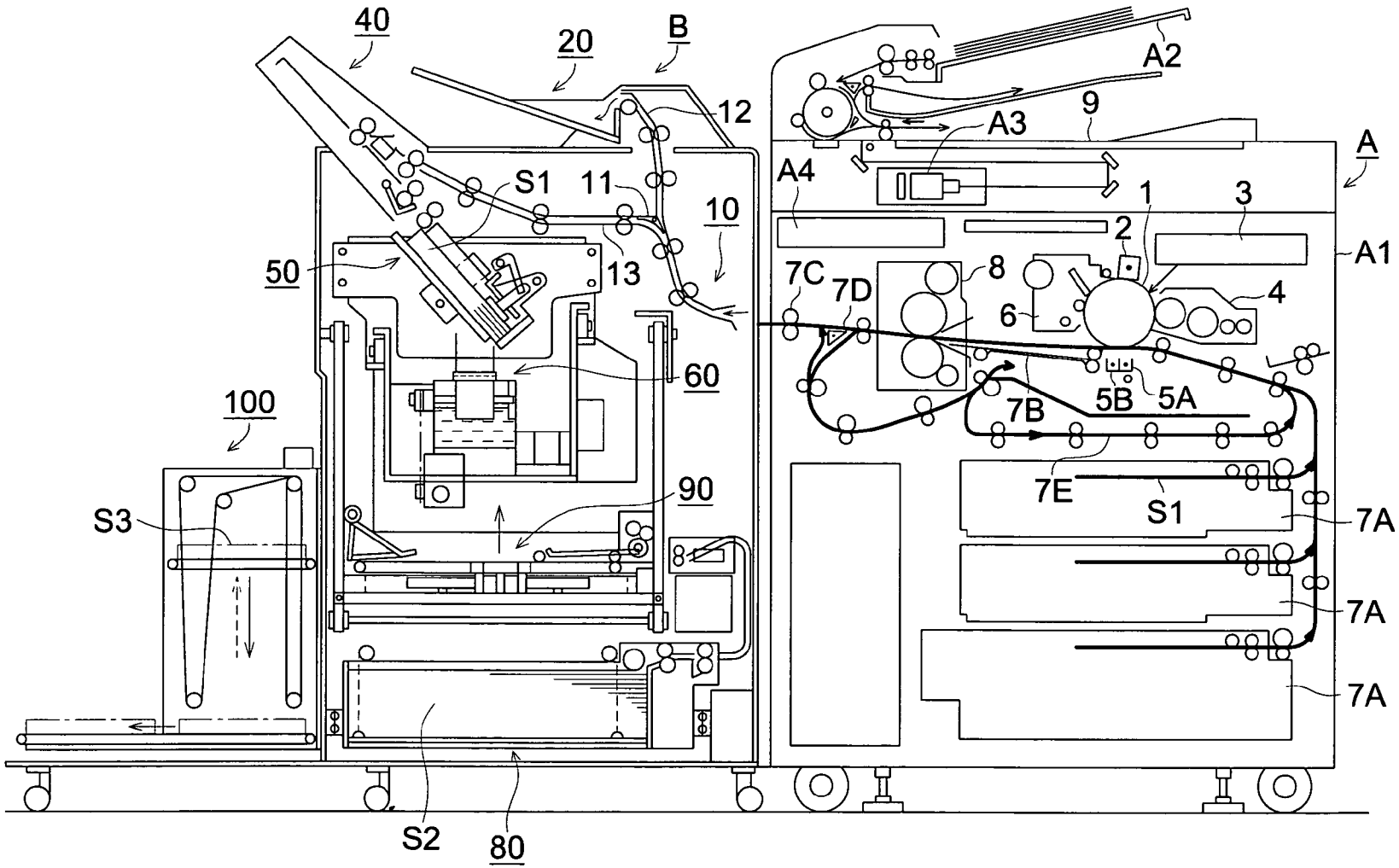
FIG. 1 is a drawing representing the overall view of the bookbinding system constituted of a bookbinding apparatus in relation to an embodiment of the present invention.

FIG. 1 is a drawing representing the overall view of the bookbinding system constituted of a bookbinding apparatus in relation to an embodiment of the present invention.

The bookbinding system includes an image forming apparatus A and bookbinding apparatus B.

The image forming apparatus A forms an image on a paper using electrophotographic process, and includes an image forming section A1, document feeder A2 and image reading section A3.

In the image forming section A1, a charging unit 2, exposing unit 3, developing unit 4, transfer unit 5A, separation unit 5B and cleaning unit 6 are arranged around a drum type photoreceptor 1. The processes of charging, exposure, development and transfer are carried out by these electrophotographic processing units, whereby a toner image is formed on the photoreceptor 1, and an image is formed on the sheet S1.

Sheets S1 are stored in three sheet feed trays 7A, and the sheets S1 are fed one by one from the sheet feed tray 7A. The toner image on the photoreceptor 1 is transferred onto the sheet S1 by the transfer unit 5A.

The toner image transferred onto the sheet S1 is fixed by a fixing unit 8. The fixed sheet S1 is ejected from an ejection roller 7C or is conveyed to the re-feeding path 7E.

In the face-down sheet ejection of the one-sided printing mode, in the one-sided printing of the face-up sheet ejection mode or in the front surface image formation of the two-sided image formation mode, the sheets S1 are switched and guided by the switching gate 7D. To be more specific, the switching gate 7D feeds the sheet S1 straight in the face-up sheet ejection, and guides the sheet S1 downward in the face-down sheet ejection and two-sided image formation.

In the face-down sheet ejection, after sheets S1 have been guided downward, they are switched back, are conveyed upward, and are ejected by the ejection roller 7C.

In the two-sided image formation, the sheets S1 are fed backward and the front and rear are reversed switchback. After that, the sheets S1 are fed along the re-feeding path 7E, and are re-fed to the transfer section equipped with a transfer unit 5A, whereby the rear image is transferred.

The document feeder A2 feeds documents one by one to the reading position. The image reading section A3 reads the image of the documents conveyed by the document feeder A2 or the image of the documents placed on a document platen 9, whereby an image signal is generated.

The bookbinding apparatus B bundles a plurality of the constituent sheets fed from the image forming apparatus A and forms them into a bundle of the constituent sheets. The bookbinding apparatus B further bonds this bundle with cover sheet paper, whereby a book is created. In the following description, this constituent paper is referred to as a sheet S1, and the cover sheet paper is called a cover sheet S2. The constituent sheets bonded with the cover sheet paper will be referred to as a booklet S3.

The bookbinding apparatus B includes: a conveying section 10 which conveys the sheets S1 having been ejected from the image forming apparatus A, to the sheet ejection tray 20 or sheet reversing section 40; a sheet ejection tray 20; a sheet reversing section 40; a stacking section 50 for stacking the sheets S1 having been fed one by one or a few sheets by a few sheets; a coating section 60; a cover sheet storage section 80 for storing the cover sheet S2; a cover sheet support section 90 for supporting the cover sheet; and a booklet ejection section 100.

The sheets S1 ejected from the image forming apparatus A are ejected to the sheet ejection tray 20 through the ejection path 12 by the switching gate 11 provided on the conveying section 10, or are conveyed to the sheet reversing section 40. Except in the bookbinding processing mode, the sheets S1 are ejected to the sheet ejection tray 20.

In the bookbinding mode, the sheets S1 are conveyed to the sheet reversing section 40 through the conveyance path 13, and are conveyed to the stacking section 50 after having been switched backed by the sheet reversing section 40. A predetermined number of sheets S1 are stacked in the stacking section 50. When a set number of sheets have been stacked, the stacking section 50 rotates to hold the bundle of the sheets S1 almost in the upright position.

The lower surface of the bundle of sheets S1 held by the stacking section 50 in the upright position is coated with adhesive by the coating section 60.

The cover sheet S2 is brought in contact with the bundle of the sheets S1 coated with adhesives, and is bonded therewith.

The booklet S3 created by the cover sheet S2 being bonded with the bundle of the sheets S1 is ejected to a booklet ejection section 100.

Figure 2:
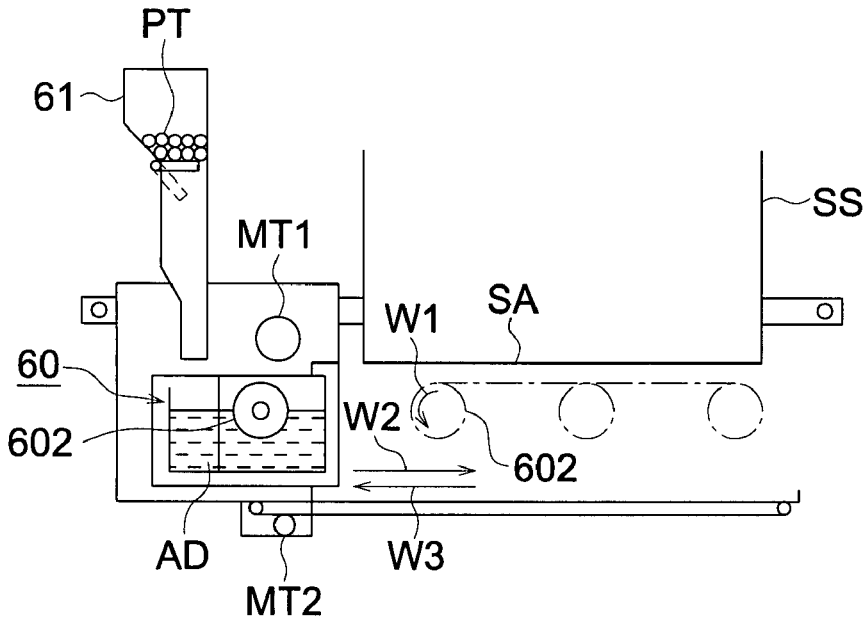
FIG. 2 is a drawing representing the process of applying an adhesive.

FIG. 2 is a drawing representing the process of applying an adhesive.

The coating section 60 is located below the sheet bundle SS. Melted adhesive AD is coated on the spine SA of the booklet SS as a bundle of the sheets S1 by the coating roller (coating member) 602 as a coating member at the time of outward movement in the direction W2 by the motor MT1. Adhesive AD is coated on the spine SA by the coating roller 602 at the time of homeward movement in the direction W3.

The home position of the coating section 60 is found on the left end in FIG. 2, and is on the further rear side as viewed from the front of the bookbinding apparatus B of FIG. 1. In the home position, pellets (solid adhesive) PT of the adhesive are supplied from the supplier 61. The coating roller 602 is rotated by the motor MT2 in the direction W1 at the time of outward and homeward movements. Adhesive is drawn up from the adhesive tank (melting section) 601, and is applied to the spine SA of the sheet bundle SS.

Figure 3:
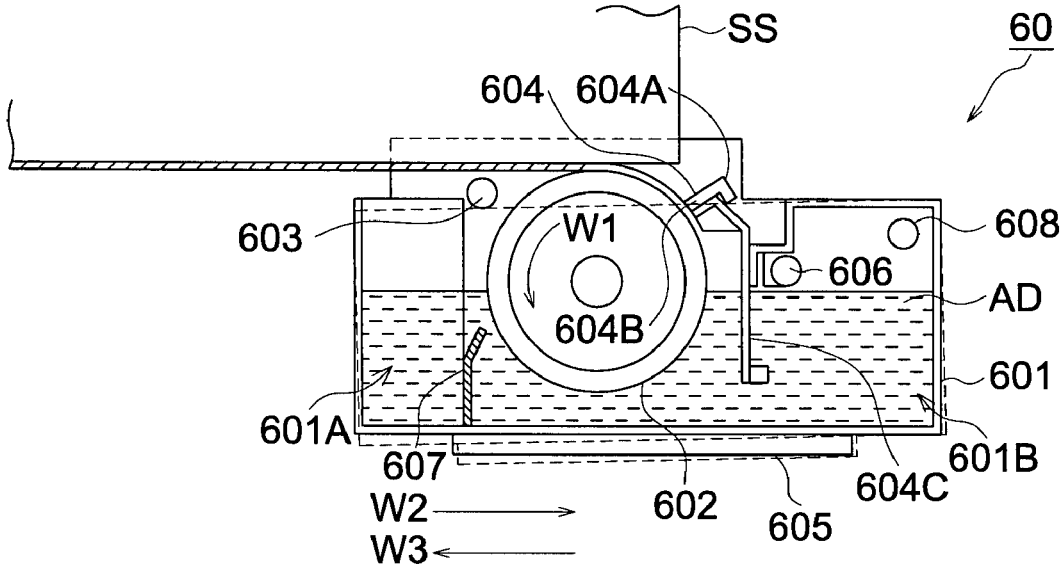
FIG. 3 is a drawing showing the structure of a coating section.

FIG. 3 is a drawing showing the structure of the coating section 60.

The coating section 60 includes an adhesive tank 601 for storing the adhesive AD, coating roller 602, regulating members 603 and 604, heater 605, adhesive amount sensor 606 and separating section 607.

The pellets PT in the adhesive tank 601 are heated and melted by the heater 605, whereby the coating solution of the adhesive AD is formed. The amount of adhesive AD is detected by the adhesive amount sensor 606 made up of a temperature sensor, and pellets PT are supplied so that the liquid is kept at a predetermined level. The regulating member 603 is a rod-like member having an almost circular cross section. The regulating member 604 is supported by the plate-formed support member 604C. The layer thickness of the adhesive coated on the coating roller 602 is regulated by the bottom edge 604B, and the layer thickness of the adhesive on the spine SA of the sheet bundle SS is regulated by the top edge 604A.

The adhesive tank 601 is set by rotating about the axis 608 from the standby status indicated by the dotted line to the coated status indicated by the solid line.

The adhesive amount sensor 606 has the temperature detection element composed of a thermistor. When the adhesive amount sensor 606 is immersed in the solution of the adhesive AD, the detected temperature is increased. When the liquid level is reduced so that the adhesive amount sensor 606 is separated from the liquid surface, the detected temperature is reduced. That the adhesive amount has been reduced below a predetermined value is recognized by the detection of this temperature reduction. When adhesive amount reduction detection signal has been outputted, the adhesive is supplied. The reference numeral 607 denotes a separating section to be described later.

FIG. 4(*a*) is a side elevation view in cross section showing the coating section 60 when the coating roller as a coating roller is rotating. FIG. 4(*b*) is a cross section taken along arrow line 4(*b*)-4(*b*) of the coating section 60. The regulating members 603 and 604, heater 605 and adhesive amount sensor 606 are not illustrated.

A separating section 607 is disposed below the supplier 61 of FIG. 2 inside the adhesive tank 601 and coating roller 602. An adhesive tank 601 is partitioned into a supply tank 601A and melting tank section 601B, using this separating section 607 as a boundary therebetween. To be more specific, the supply tank 601A for supplying pellets PT is located on the illustrated left side of the separating section 607, and the melting tank section 601B including the coating roller 602 and adhesive amount sensor 606 is located on the right side of the separating section 607.

FIG. 4(*a*) shows that the coating roller 602 is currently rotating. A greater amount of the adhesive AD in the adhesive tank 601 is supplied to the right of the coating roller 602 by the rotation of the coating roller 602. Accordingly, the liquid levels of adhesive AD in the adhesive tank 601 are different on the right and left separated by the coating roller 602. However, if the rotation of the coating roller 602 has stopped, the liquid adhesive AD levels are the same on the right and left.

Figure 5:
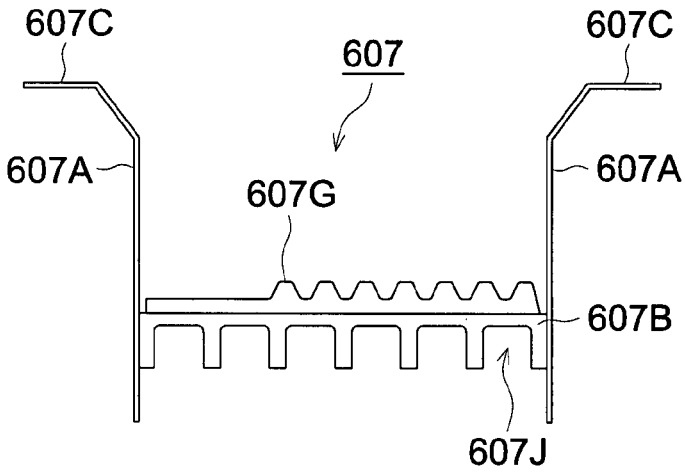
FIGS. 5(*a*)-5(*c*) are the side view, front view and perspective view representing the separating section, respectively.
Figure 5:
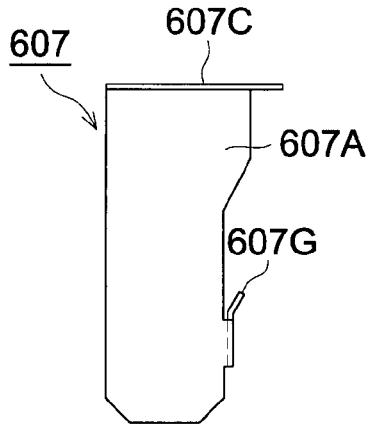
Figure 5:
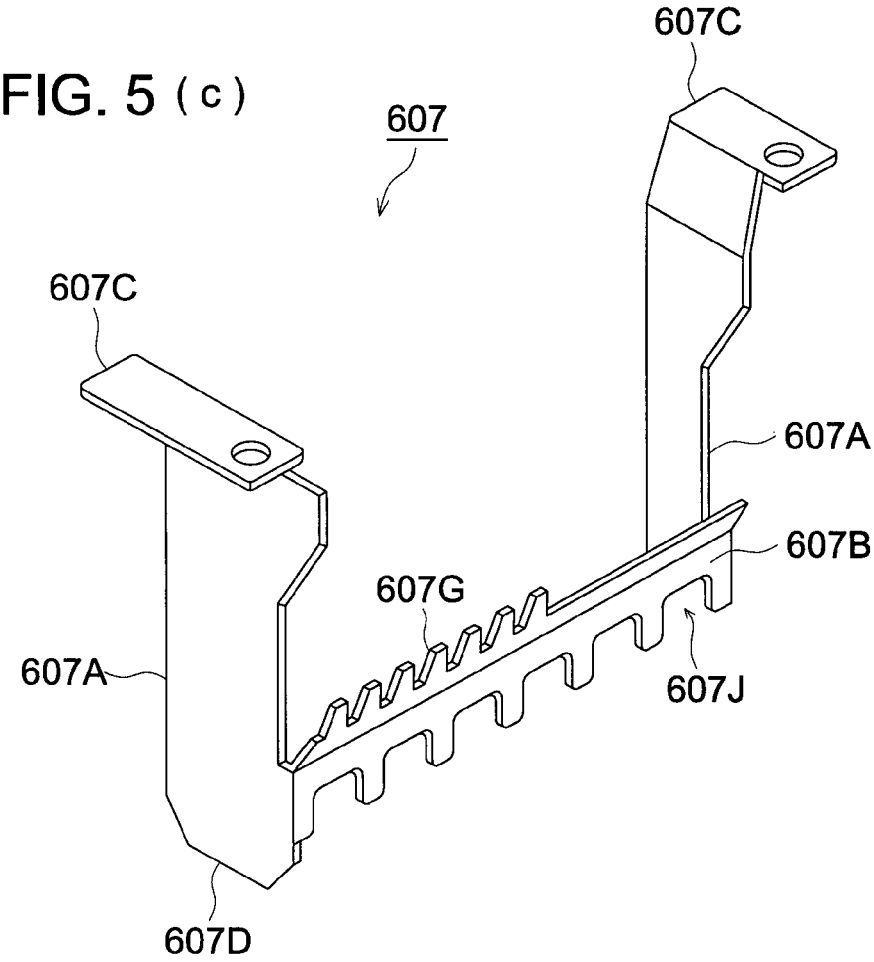

FIGS. 5(*a*)-5(*c*) show the separating section 607. FIG. 5(*a*) is the side view of the separating section 607, FIG. 5(*b*) is the front view and FIG. 5(*c*) is the perspective view, respectively.

The separating section 607 includes a pair of upright side plates 607A on the right and left, a fence section 607B for bridging the bottom portion of the side plate 607A, and an installation surface 607C formed on each top of a pair of the side plates 607A on the right and left. These components are molded into one integral body. The separating section 607 is processed by pressing through the use of a thin plate such as a stainless steel and phosphor bronze plate.

The installation surface 607C is fixed on the top surface of the adhesive tank 601 by screws, as shown in FIGS. 4(*a*)-4(*b*). The bottom section 607D of the side plate 607A of the separating section 607 comes in contact with the bottom section inside the adhesive tank 601, as shown in FIGS. 4(*a*)-4(*b*).

The fence section 607B is provided with a plurality of tunnel-shaped passages 607J. The passage 607J allows the melted adhesive AD to pass by, and blocks the traveling of the unmelted pellets PT of large diameter coming from the supplier 61.

To be more specific, the passage 607J of the fence section 607B prevents the half-melted pellets PT of large diameter from being conveyed deposited on the coating roller 602, and from being bonded on the spine section of the sheet bundle SS, which might result in a gluing failure. The passage 607J allows the unmelted pellets PT of reduced diameter to pass by. The pellets PT of reduced diameter go through the passage 607J and are melted by the melting tank section 601B.

The half-melted pellets of smaller diameter and melted adhesive AD passing through the passage 607J are fed to the melting tank section 601B equipped with a coating roller 602, wherein they are melted and are coated on the outer peripheral surface of the rotating coating roller 602.

A plurality of protrusions 607G are formed on the upper portion of the fence section 607B. The front end of the protrusion 607G is placed close to the outer peripheral surface of the coating roller 602 maintaining a predetermined interval. The protrusions 607G are provided to ensure at the time of gluing on the sheet bundle SS that, when small blocks of unmelted pellets PT has been fed inside the adhesive AD and they have been deposited on the surface of the coating roller 602, they are separated from the surface of the coating roller 602 and are returned to the supply tank section 601A. The protrusions 607G are not provided along the entire length of the protrusion 607G. This is because the required minimum effect can be obtained if they are provided in the area of the maximum thickness of the sheet bundle that can be glued.

The separating section 607 is arranged in such a way that the fence section 607B is located at the same position as the liquid adhesive AD level in the adhesive tank 601 when the coating roller 602 is rotating. This arrangement effectively eliminates the possibility that the solid pellets PT immediately after being supplied would be fed to the side of the coating roller 602. This is estimated to be because the solid pellets PT immediately after supply tends to float close to the adhesive AD liquid surface.

Figure 6:
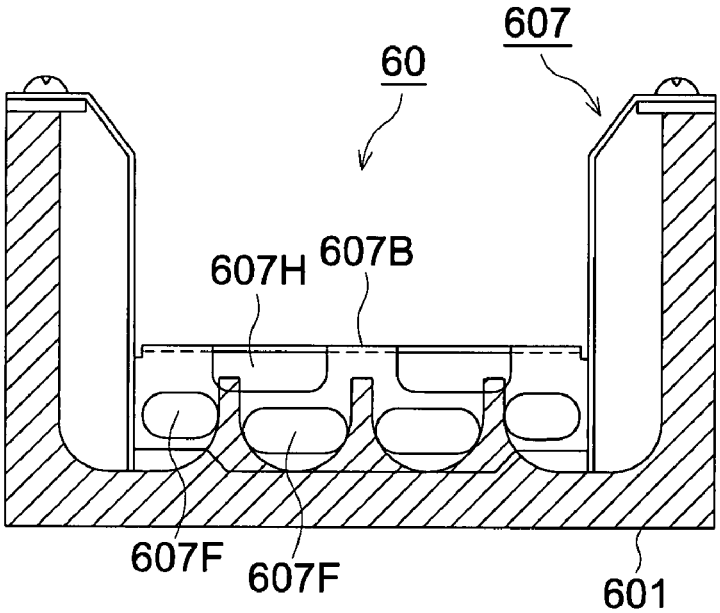
FIGS. 6(*a*)-6(*b*) are the side elevation view in cross section as another embodiment of the coating section and a front view of the separating section, respectively.
Figure 6:
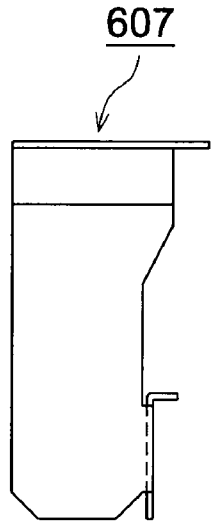

FIG. 6(*a*) is the side elevation view in cross section as another embodiment of the coating section 60. FIG. 6(*b*) is a front view of the separating section 607. These drawings use the same reference numerals of FIGS. 5(*a*)-5(*c*) for the portions having the same functions as those of FIGS. 5(*a*)-5(*c*). Only the differences from FIGS. 5(*a*)-5(*c*) will be described below.

The fence section 607B of the separating section 607 is provided with four elongated circular through-holes 607F long in the horizontal direction. The upper portion of the elongated circular hole 607F is provided with two rectangular through-holes 607H.

Figure 7:
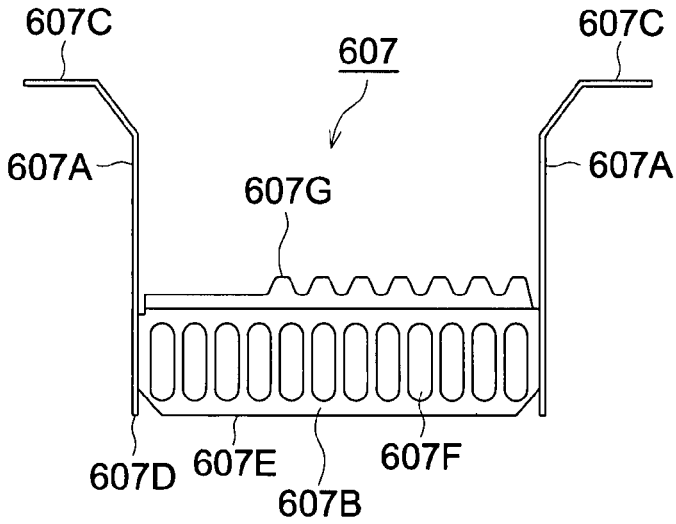
FIGS. 7(*a*)-7(*c*) are the side view, front view and perspective view representing another embodiment of the separating section, respectively.
Figure 7:
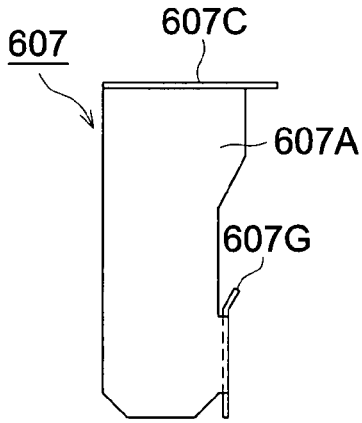
Figure 7:
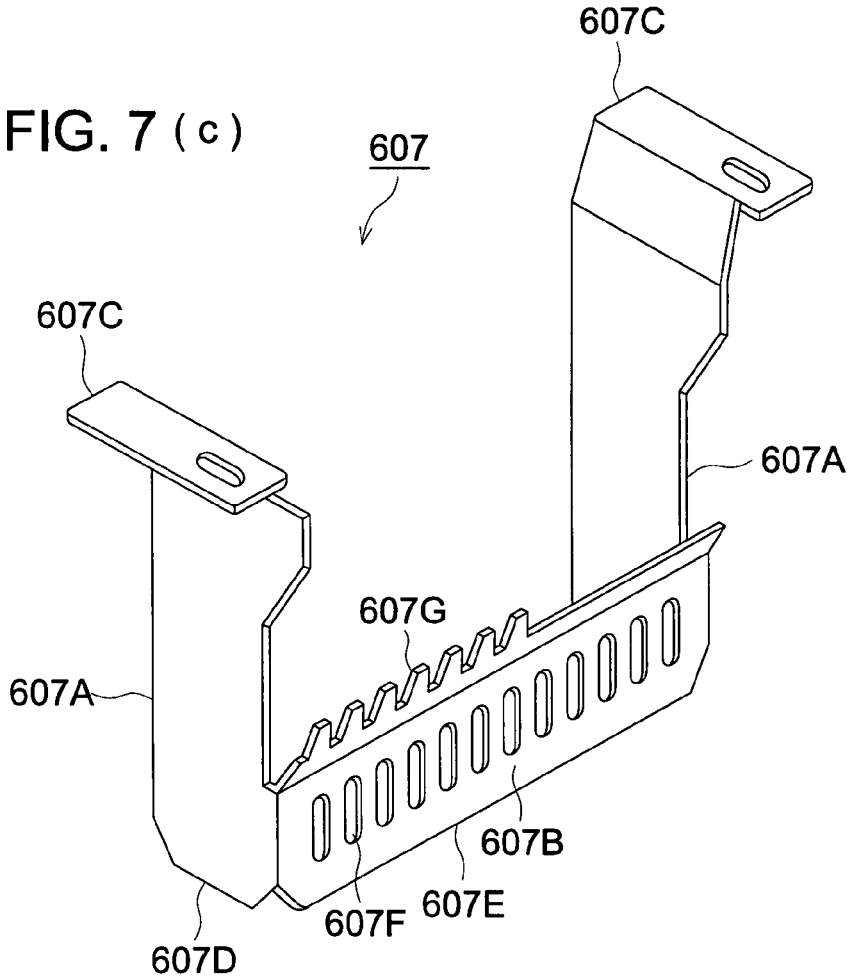

FIGS. 7(*a*)-7(*c*) show another embodiment of the separating section 607. FIG. 7(*a*) is a side view of the separating section 607, FIG. 7(*b*) is a front view, and FIG. 7(*c*) is a perspective view, respectively. These drawings uses the same reference numerals of FIGS. 5(*a*)-5(*c*) for the portions having the same functions as those of FIGS. 5(*a*)-5(*c*). Only the differences from FIGS. 5(*a*)-5(*c*) will be described below.

The fence section 607B is provided with a plurality of elongated circular through-holes 607F. The through-holes 607F allow the melted adhesive AD to pass by, and block the traveling of the unmelted pellets PT coming from the supplier 61. To be more specific, the through-holes 607F of the fence section 607B eliminate that possibility that the half-melted pellets PT is conveyed deposited on the coating roller 602, and is adhered on the spine section of the sheet bundle SS, which might result in a gluing failure.

The half-melted pellets of smaller diameter and melted adhesive AD passing through the through-hole 607F are fed to the melting tank section 601B equipped with a coating roller 602, wherein they are further melted and are coated on the outer peripheral surface of the rotating coating roller 602.

A plurality of protrusions 607G are formed on the upper portion of the fence section 607B. The front end of the protrusion 607G is placed close to the outer peripheral surface of the coating roller 602 maintaining a predetermined interval.

Figure 8:
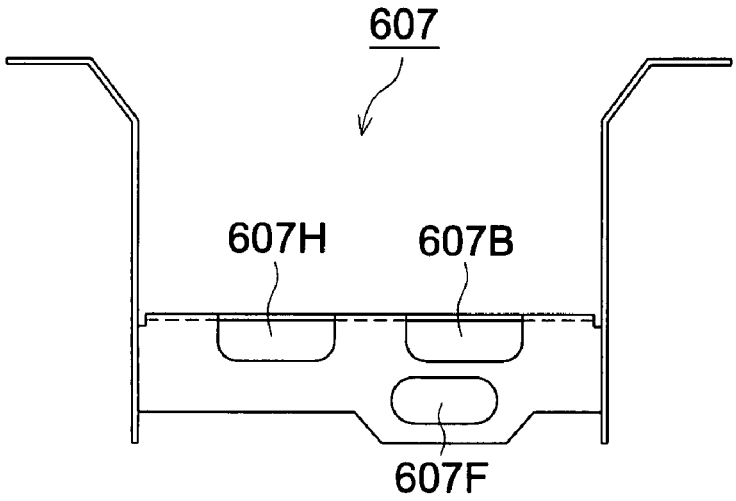
FIGS. 8(*a*)-8(*b*) are the side view representing still another embodiment of the separating section, and the front view representing the separating section, respectively.
Figure 8:
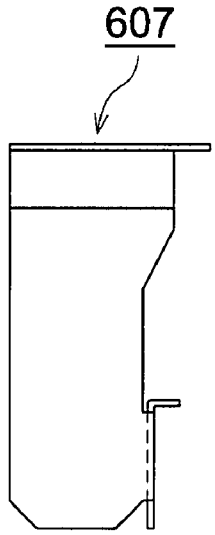

FIG. 8(*a*) is a side view representing still another embodiment of the separating section 607. FIG. 8(*b*) is a front view representing the separating section 607. These drawings uses the same reference numerals of FIGS. 6(*a*)-6(*b*) for the portions having the same functions as those of FIGS. 6(*a*)-6(*b*). Only the differences from FIGS. 6(*a*)-6(*b*) will be described below.

The fence section 607B of the separating section 607 is provided with an elongated circular through-hole 607F long in the horizontal direction, and upper portion of the through-hole 607F is equipped with two rectangular through-holes 607H.

Figure 9:
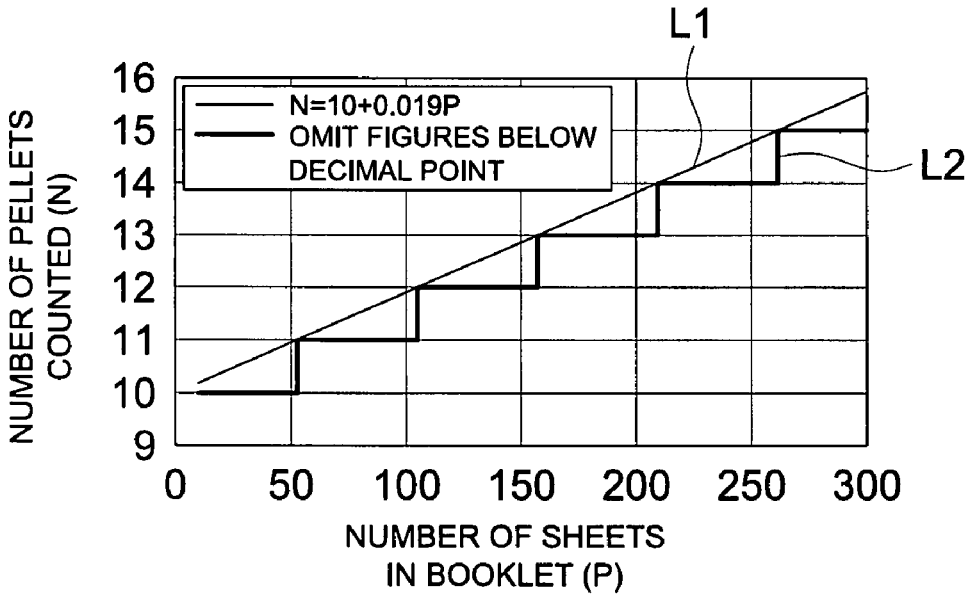
FIG. 9 is a diagram representing the percentage of the supply for proper bonding with reference to the number of sheets constituting a sheet bundle.

FIG. 9 is a diagram representing the percentage of the supply for proper bonding with reference to the number of sheets constituting a sheet bundle.

As described above, the reduction in the adhesive AD liquid level is detected and adhesive pellets PT are supplied in response to the detection signal. The following describes the percentage of the pellets PT to be supplied, with reference to FIG. 9.

In FIG. 9, the horizontal axis indicates the number P of sheets S1 constituting the sheet bundle SS, and the vertical axis indicates the number C of pellets PT to be supplied, that have been counted by a supply sensor FS. This is the result of the coating test having been conducted using the coating section 60 of FIG. 3.

In FIG. 9, the horizontal axis represents the number of sheets P in booklet S3. Theoretically, it indicates the amount of the adhesive AD consumed by coating. The amount of the adhesive AD consumed corresponds to the thickness of the sheet bundle SS mainly determined by the number P of the sheets S1 and the thickness of one sheet S1, and paper size. Further, the amount of consumption also depends on the type of paper such as coated paper or non-coated paper.

The straight line L1 is expressed by the following equation.

$$N=10+0.019 \quad \text{Equation 1}$$

In this case, the count of the supply sensor FS is not always equal to the number of the pellets PT to be supplied. In the test example, one count of the supply sensor FS corresponded to 2.5 pellets PT.

In the actual control, as shown in the stair-shaped line L2, the number of the pellets PT wherein the figures below decimal are omitted is used for control as representing the proper amount of supply. The adhesive amount sensor adhesive amount sensor 606 (shown in FIG. 3) receives the signal having detected the reduction in liquid level, and supply of the pellets PT is started. The count corresponding to the amount of supply corresponding to the number of sheets is given by Equation 1, and the proper value illustrated in FIG. 9 is reached. Then the controller terminates the supply.

The aforementioned control ensures the liquid adhesive surface to be kept at an almost constant level at all times, whereby uniform coating is performed.

Figure 10:
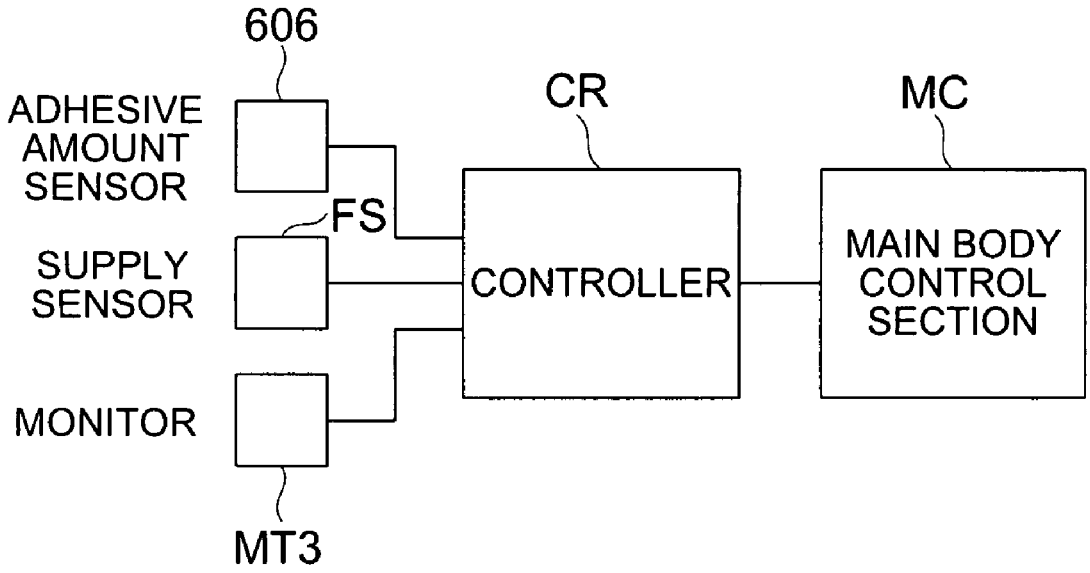
FIG. 10 is a block diagram of the control system for controlling adhesive supply.
Figure 11:
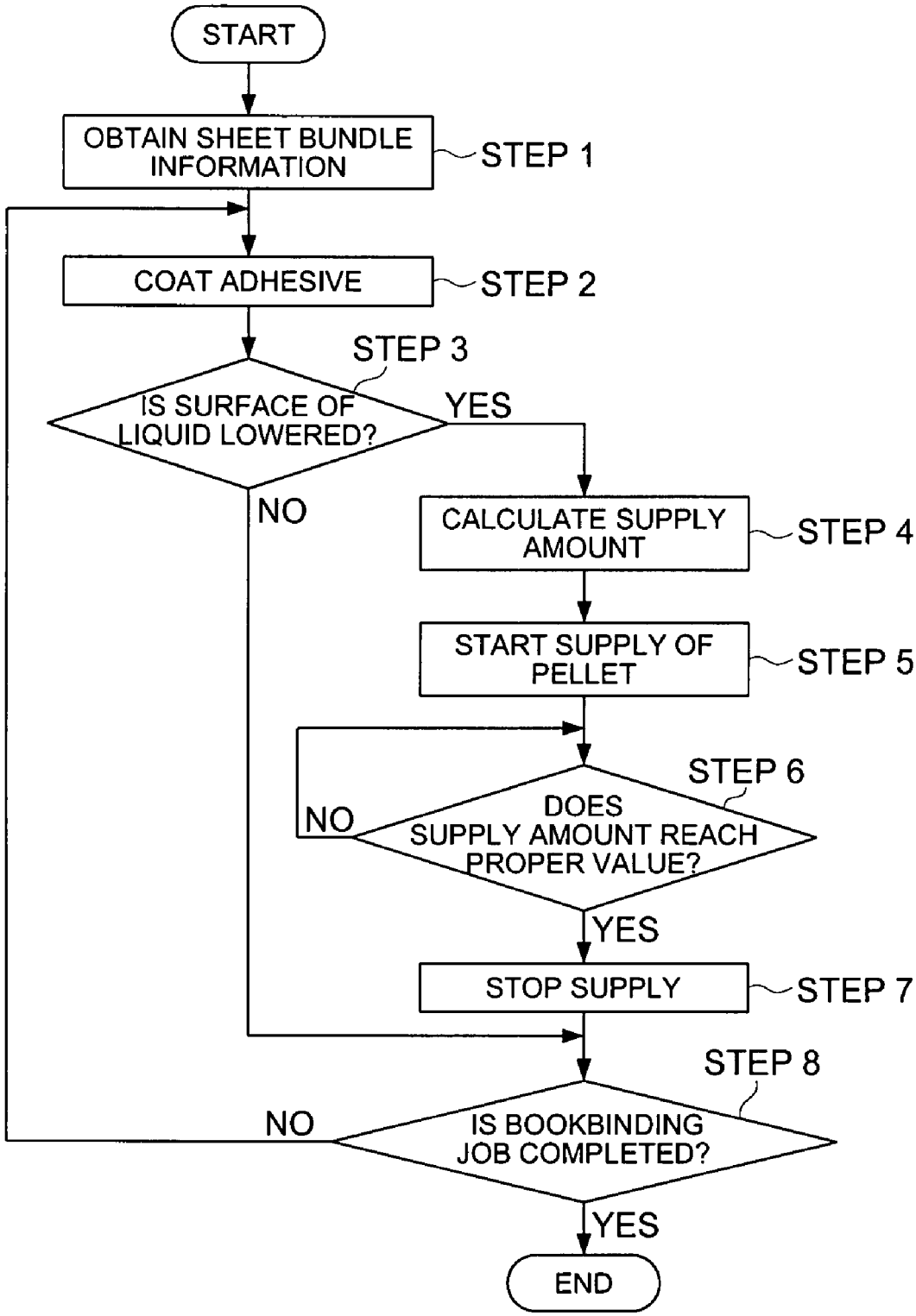
FIG. 11 is a flow chart of coating control.

Referring to FIGS. 10 and 11, the following describes the adhesive supply control.

FIG. 10 is a block diagram of the control system for controlling adhesive supply, and FIG. 11 is a flow chart of coating control.

The controller CR provides the pellet PT supply control, wherein information on the sheet bundle SS is obtained from the main body control section MC as the control section of the image forming apparatus A, and the driving motor MT3 constituting a supplier for supplying pellets PT is initiated, in response to the signal having detected the liquid level of the adhesive amount sensor 606 for detecting the liquid level in the adhesive tank, whereby pellets PT are supplied. When the supply amount obtained from the supply amount detection signal of the supply sensor FS has reached a proper value, the motor MT3 is terminated under this control.

In STEP 1, information on the sheet bundle SS to be coated with adhesive AD is inputted. The information on the sheet bundle SS includes the number of sheets constituting the booklet S3, the thickness of paper, the type of paper such as coated paper or non-coated paper, and the size of paper.

In STEP 2, the coating section 60 performs a back-and-forth motion, whereby adhesive is coated on the spine of the sheet bundle SS.

In STEP 3, a step is taken to detect the reduction in the adhesive liquid level subsequent to implementation of coating process in STEP 2. If the reduction is not detected (N in STEP 3), the system terminates the procedure. If it has been detected (Y in STEP 3), the proper coating amount is calculated (STEP 4).

The calculation in STEP 4 is performed, for example, according to the stair-shaped line L2 of FIG. 9 with reference to the Lookup Table stored in the memory section of the controller CR.

In STEP 5, pellet supply starts.

In STEP 6, the output of the supply sensor FS is monitored. When the count of the supply sensor FS has reached the proper value (Y in STEP 6), supply stops and the procedure terminates (STEP 7).

When a predetermined number of booklets S3 have been produced and the bookbinding job has completed (Y in STEP 8), the procedure terminates. If not, the system goes back to STEP 2 (N in STEP 8).

In FIGS. 10 and 11, the controller CR inputs the information of the sheet bundle SS, and the pellet supply amount is determined based on the inputted information. However, the information on the sheet bundle SS includes the number of sheets P, and the thickness, type and size of the sheets. The controller CR calculates information required for calculation of the percentage of supply from such information. In addition to this automatic supply, the operator can directly set the percentage of supply.

For example, it is also possible to make such arrangements that the percentage of supply is assigned with a several steps, and the operator selects and sets the proper percentage of supply according to the thickness of the sheet bundle SS and others. Thus, the setting of the operator is inputted into the controller CR as information on the sheet bundle SS.

In the automatic supply control, the controller CR obtains information on the number of sheets, the thickness and size of the sheet and others from the image forming apparatus A and calculates the proper percentage of supply. It is also possible to arrange such a configuration that the stacking section 50 of the sheet bundle SS of FIG. 1 is provided with a sheet thickness sensor for detecting the thickness of the sheet bundle SS, and the controller CR calculates the proper percentage of supply in response to the detection signal of the sheet thickness sensor.

The present embodiment of the present invention provides a bookbinding apparatus and a bookbinding system wherein, in a downsized coating section, a separating section prevents the half-melt solid adhesive from being coated onto the end face (spine) of the booklet by the coating section, whereby a high-quality booklet with a high degree of bonding strength is created.

What is claimed is:

1. A bookbinding apparatus comprising:

an adhesive tank;

a supplier which supplies solid adhesive to the adhesive tank;

a melting section which melts the solid adhesive supplied to the adhesive tank;

a coating member which coats the adhesive melted in the adhesive tank to a booklet; and a separating section which separates the coating member from a portion of the adhesive tank to which the solid adhesive is supplied by the supplier.

2. The bookbinding apparatus of claim 1, wherein the coating member comprises a coating roller which picks up the melted adhesive in the adhesive tank while the coating member is immersed and rotated in the melted adhesive.

3. The bookbinding apparatus of claim 1, wherein the separating section comprises a fence section which inhibits the solid adhesive from moving to the coating member.

4. The bookbinding apparatus of claim 3, wherein the coating member comprises a coating roller that is capable of being rotated and stopped while the coating roller is immersed in the melted adhesive in the adhesive tank, and a height of the fence section is the same as a liquid surface level of the melted adhesive in the adhesive tank when the coating roller is rotated.

5. The bookbinding apparatus of claim 4, wherein the height of the fence section is lower than the liquid surface level of the melted adhesive in the adhesive tank when the coating roller is stopped.

6. The bookbinding apparatus of claim 1, wherein the separating section comprises protrusions which scrape, from the coating member, unmelted solid adhesive that is adhered to a surface of the coating member, from the coating member.

7. A bookbinding system comprising:

an image forming apparatus which forms an image on a sheet; and the bookbinding apparatus of claim 1;

wherein the bookbinding apparatus receives the sheet from the image forming apparatus, and performs a gluing and bookbinding process.

8. The bookbinding apparatus of claim 3, wherein the coating member comprising a coating roller.

9. The bookbinding apparatus of claim 8, wherein the fence section comprises a passage which allows adhesive that has been at least partially melted to pass through, and the passage is provided downstream, in a rotating direction of the coating roller, of a position at which the coating roller applies the adhesive to the booklet.

10. The bookbinding apparatus of claim 1, wherein the adhesive tank is adapted to be moved away from and returned to a home position.

11. The bookbinding apparatus of claim 10, wherein the supplier supplies the solid adhesive to the adhesive tank when the adhesive tank is positioned at the home position.

12. The bookbinding apparatus of claim 6, wherein the protrusions are provided only along a length of separating section corresponding to a maximum booklet thickness to which the bookbinding apparatus is capable of applying adhesive.

13. The bookbinding apparatus of claim 1, further comprising an adhesive amount sensor which detects a liquid level of the adhesive stored in the adhesive tank.

* * * * *